US007166044B1

(12) United States Patent
Lambert

(10) Patent No.: US 7,166,044 B1
(45) Date of Patent: Jan. 23, 2007

(54) PUTTER'S TRAINING AID

(76) Inventor: David P. Lambert, 7425 Falls Ridge Ct., Louisville, KY (US) 40241

( * ) Notice: Subject to any disclaimer, the term of this patent is extended or adjusted under 35 U.S.C. 154(b) by 81 days.

(21) Appl. No.: 10/943,519

(22) Filed: Sep. 17, 2004

(51) Int. Cl.
*A63B 57/00* (2006.01)

(52) U.S. Cl. ..... 473/404

(58) Field of Classification Search ..... 473/404, 473/173–176, 179, 180, 195; 33/377, 379–390
See application file for complete search history.

(56) References Cited

U.S. PATENT DOCUMENTS

| | | | | | |
|---|---|---|---|---|---|
| 666,843 | A | * | 1/1901 | Brownell | 33/390 |
| 669,068 | A | | 3/1901 | Arthur | |
| 963,959 | A | * | 7/1910 | Stratton | 33/384 |
| 1,920,892 | A | * | 8/1933 | Rogers | 33/387 |
| 2,356,311 | A | | 8/1944 | Geier | |
| 2,469,795 | A | * | 5/1949 | Sproul | 33/390 |
| 2,706,341 | A | * | 4/1955 | Havens | 33/370 |
| 3,751,819 | A | | 8/1973 | Dixon | |
| D249,657 | S | | 9/1978 | Griffiths | |
| 4,984,791 | A | | 1/1991 | Labell | |
| D318,243 | S | | 7/1991 | Piskula | |
| 5,326,096 | A | | 7/1994 | H'Doubler | |
| 5,330,179 | A | | 7/1994 | Hampel | |
| D353,177 | S | | 12/1994 | Haugland | |
| 5,382,018 | A | * | 1/1995 | Browne | 473/175 |
| 5,403,001 | A | | 4/1995 | Skorpinski | |
| 5,411,253 | A | | 5/1995 | Kimble | |
| 5,431,391 | A | | 7/1995 | Tracey | |
| 5,476,258 | A | | 12/1995 | Frisone | |
| 5,503,393 | A | | 4/1996 | Casperson | |
| 5,662,535 | A | | 9/1997 | Smith | |
| 5,669,832 | A | | 9/1997 | Lehse | |
| 5,707,299 | A | | 1/1998 | McKenna | |
| 5,792,015 | A | | 8/1998 | Hoyt et al. | |
| 5,865,689 | A | | 2/1999 | Heyman | |
| 6,095,933 | A | | 8/2000 | Smith | |
| 6,386,994 | B1 | | 5/2002 | H'Doubler et al. | |

* cited by examiner

*Primary Examiner*—Steven Wong
(74) *Attorney, Agent, or Firm*—Camoriano and Associates; Theresa Fritz Camoriano

(57) ABSTRACT

A device and a method for training a golfer to putt a golf ball into a hole. The device includes a slope indicator, which provides a visual indication of the slope of the slope of the golf green at the rim of the hole. The golfer marks the slope and practices different lines of approach of the ball to the hole, and at different distances, until he can accurately and consistently sink the putt from any approach on the green.

11 Claims, 3 Drawing Sheets

PUTTER'S TRAINING AID

BACKGROUND OF THE INVENTION

The present invention relates to a golf putter's training aid. More particularly, it relates to a device which visually indicates the direction and the extent of the slope of the green immediately adjacent the rim of the hole, and a method for training a golfer to learn to read the slope of the green and compensate for this slope in order to improve his accuracy in sinking the putt.

The prior art uses slope indicators either at the location of the ball on the green or at an imaginary line extending from the location of the ball on the green to the location of the hole in order to try to ascertain the slope, and in some instances the extent of the slope, of a particular putt. Several of the prior art devices and methods are complicated to use and may involve the graphing of the slope of the green in order to determine how to aim a particular stroke in order to sink the putt.

SUMMARY OF THE INVENTION

The present invention provides a putter's training aid including a portion sized to fit within a golf hole while a flange rests atop the golf hole. In a preferred embodiment, a circular bubble level is housed within a body which includes a downwardly-projecting shoulder to substantially align the slope indicator with the golf hole. A preferred embodiment includes a slope indicator with a plurality of circular indicia to give a visual indication not only of the slope but also of the extent of the slope.

The putter's training aid also may include a set of radially oriented markings, preferably a pair of orthogonally oriented cross-hairs, and these markings are preferably located on the flange. These markings may be aligned with the high spot on the golf green at the rim of the hole, which is then designated as the 12:00 O'clock position, with the remaining three cardinal points corresponding to the 3:00 O'clock, 6:00 O'clock, and 9:00 O'clock positions. The golf green at the rim of the hole may be marked temporarily at these cardinal points (by placing standard ball markers on the green, for instance). The golfer then makes a mental note of the extent and orientation of the slope and practices putting in order to master sinking the putt regardless of the approach of the ball to the hole. In addition to practicing putting from different orientations, the golfer may practice putting from different distances.

Eventually the golfer learns to extrapolate the skills learned in a specific hole and, by reading the slope and the extent of the slope of a golf green at the rim of a hole, noting the approach of the ball to the hole relative to the 12:00 position, and noting also the distance of the ball to the hole, he can accurately estimate the degree of correction required in order to sink the putt. Finally, the golfer may even become so adept at reading the green that he can accurately estimate the slope and the extent of the slope of the golf green at the rim of the hole without the use of the training aid.

Another embodiment includes a guide ring so that the putter's training aid may rotate more freely within the hole. In yet another embodiment, the guide ring is replaced by a reel mechanism which plays out and re-coils a cord (or tape measure) used to assist the putter in determining the direction and distance from which to practice his putts.

DESCRIPTION OF THE PREFERRED EMBODIMENT

Figure 1:
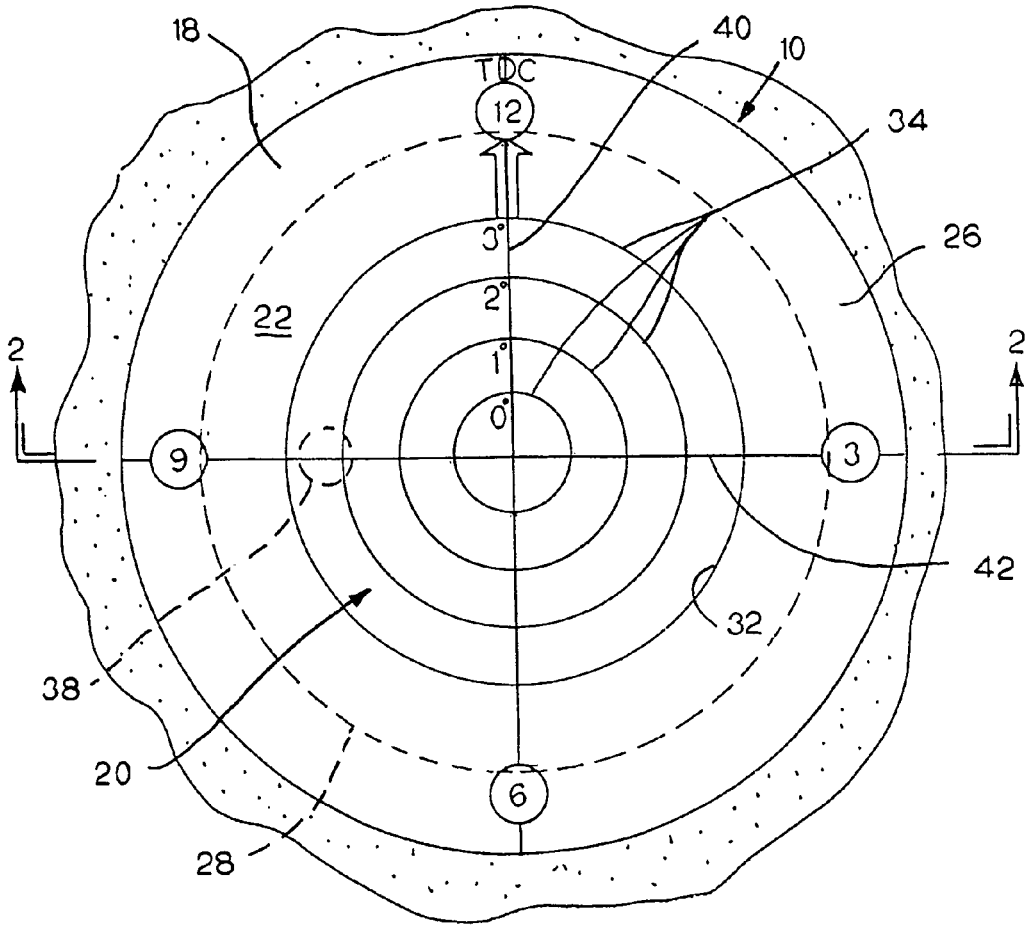
FIG. 1 is a plan view of an embodiment of a putter's training aid made in accordance with the present invention, as installed in a golf hole.
Figure 2:
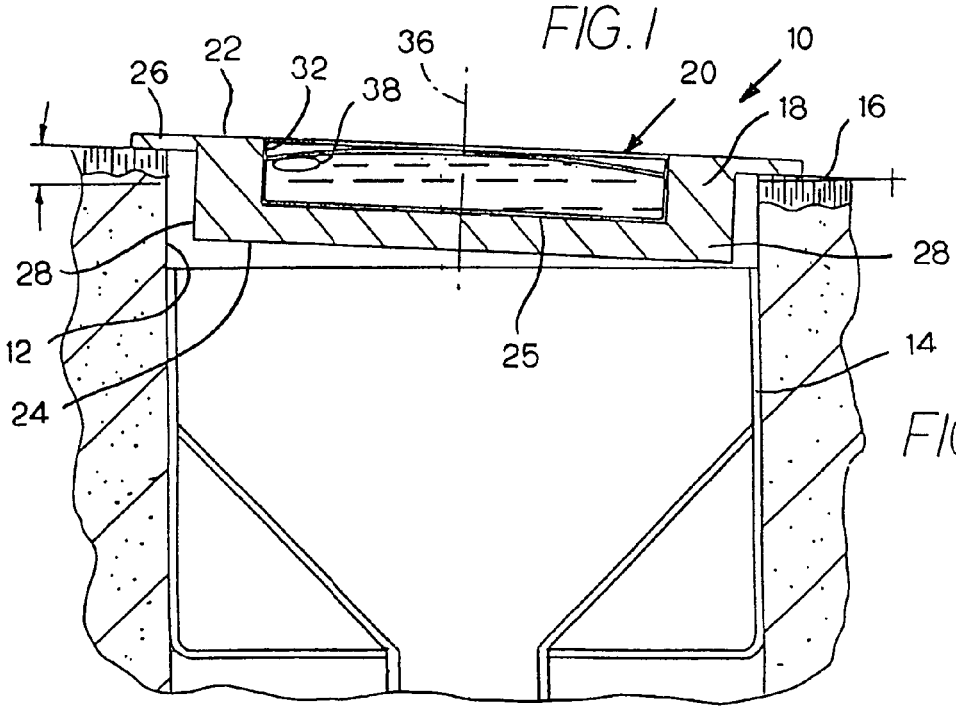
FIG. 2 is a broken-away, section view along line 2—2 of FIG. 1.

FIGS. 1 and 2 depict a putter's training aid 10, made in accordance with the present invention, being used to measure the slope of a green at the rim of a golf hole 12. Inside the hole 12 is the cup 14 (also referred to as the hole insert and flagstick holder 14). Surrounding the hole 12 is the golf green 16 at the rim of the hole 12. The inside diameter of the hole 12 and the outside diameter (OD) of the cup 14 is 4.25 inches for a standard hole. The cup 14 is typically recessed approximately ½" to 1" or more below the top of the hole 12.

The putter's training aid 10 includes a body 18, with a slope indicator 20 mounted on the body 18. The slope indicator 20, shown in this embodiment 10, is a bubble level, which includes a bubble 38 floating in a liquid, but it may be another type of slope indicator, such as the spherical ball on a concave surface shown in FIGS. 3 and 4, as described in more detail later.

The body 18 has a top 22 and a bottom 24 and includes a radially outwardly-projecting flange 26, which is sized to rest on the green 16 immediately surrounding the hole 12. The body 18 also includes a base 28 projecting downwardly from the flange 26. The base 28 is sized to fit closely within the hole 12 so as to substantially align the putter's training aid 10 within the golf hole 12. It is preferred that the diameter of the base 28 be between 50% and 99% of the diameter of the standard hole 12, more preferable that the diameter of the base be at least 70% of the diameter of the standard hole, and most preferable that the diameter of the base 28 be between 80% and 90% of the diameter of the standard hole. It is also preferred that the flange 26 have a diameter that is at least 105% of the diameter of the standard hole, and most preferable that the flange 26 have a diameter between 110% and 140% of the diameter of the standard hole, so the flange 26 can rest on the green at the rim of the hole and define the slope of the green at the rim. It is also preferable that the base 28 project downwardly from the flange 26 a distance between 1% and 100% of the diameter of the standard hole, and most preferable that the base 28 project downwardly from the flange 26 a distance between 5% and 25% of the diameter of the standard hole. By projecting downwardly only a relatively short distance, the base can have a diameter that is close to the diameter of the hole, so it is properly centered in the hole, while still being able to tilt a bit within the hole in order to follow the slope of the green.

A slope indicator 20, described in more detail below, is mounted on the body 18 so the slope indicator 20 may be read from the top 22 of the body 18. In this particular embodiment of a putter's training aid 10, the body 18 defines a cavity 32, which receives the slope indicator 20 so that it is flush mounted to the top 22 of the body 18, and the flange 26 is also flush mounted to the top 22 of the body 18. However, it is not necessary for the slope indicator 20 and the flange 26 to be flush mounted to the top 22 of the body 18. The bottom surface of the flange 26 preferably is flat (although it may include indentations from the flat surface), so the bottom surface of the flange 26 follows the slope of the green.

The slope indicator 20 is a circular bubble level 20, and it includes a plurality of concentric, circular indicia 34 to give a visual indication of the slope (the angle of recline) of the flange 26, visible from the top. Other indicia, besides circular indicia, such as hash marks, could be used. The indicia can be at the bottom of the level 20, on the level 20, or on a graphic overlay (not shown) adhered to the top surface of the level 20, and so forth. In this embodiment 10, the bottom 25 of the slope indicator 20 is substantially parallel to the bottom surface of the flange 26 and to the bottom 24 of the body 18.

The putter's training aid 10 also includes a pair of orthogonally-oriented markings 40, 42, visible from the top, and these markings 40, 42 may extend on to the flange 26, as shown in FIG. 1. In this embodiment 10, the flange 26 is also marked with an arrow 44 pointing to the lettering "TDC", which stands for Top Dead Center. This TDC point is also marked "12" to designate it as the 12:00 o'clock position. The other three ends of the orthogonally-oriented markings 40, 42, are marked "3", "6", and "9" to designate them as the 3:00 o'clock, 6:00 o'clock, and 9:00 o'clock positions, respectively. Of course, other indicia could be used to indicate the top dead center and various angles from top dead center.

The putter's training aid 10 defines an imaginary longitudinal axis 36 extending from the top 22 to the bottom 24. The putter's training aid 10 may be rotated about this axis 36 while the base 28 is within the hole 12, so as to vertically align the top dead center or 12 o'clock marking 40 with the bubble 38 in the bubble level 20, such that the bubble 38 is closest to the 12:00 O'clock position. As shown in FIG. 1, the training aid or slope indicator 10 has not yet been rotated to align the 12 o'clock position with the bubble 38, so the bubble 38 is vertically aligned with the 9 o'clock position.

To use the putter's training aid or slope indicator 10, a golfer removes the flag from the hole 12 and places the base 28 of the putter's training aid 10 in the hole 12, with the bottom surface of the flange 26 resting on the green 16 immediately surrounding the hole 12. The bubble 38 in the level indicator 20 moves so as to indicate the slope of the flange (and the green), and the extent of the slope, as shown in FIG. 1, which shows the slope to be approximately 2.5 degrees.

The golfer then rotates the putter's training aid 10 about its axis 36 until the top dead center or 12 o'clock marking 40 is vertically aligned with the bubble 38. The golfer marks this spot by placing a standard ball mark, or a small coin, on the green 16 to mark the highest spot on the green 16 immediately surrounding the rim of the hole 12 and designates this as the 12:00 o'clock position. Three more marks may be placed on the green, corresponding to the 3:00 o'clock, 6:00 o'clock, and 9:00 o'clock positions. The golfer also makes a mental note of the degree or extent of the slope as indicated by the slope indicator 20. The putter's training aid 10 is then removed from the hole 12, leaving the ball marks in place, and the hole 12 is now set for accurate practice.

The golfer starts by putting at a distance of about 2 feet from the hole 12, beginning at the the 6:00 O'clock position. This is a straight uphill putt. Then he proceeds to the 12:00 O'clock position at the same distance from the hole 12 to practice a straight downhill putt. When comfortable with these straight putts at 2 feet, he moves out to 3 feet and repeats them until he is making all his putts, indicating that his stroke and putter face are now in proper alignment.

Next, he moves to the 3:00 o'clock and the 9:00 o'clock positions to practice the left-breaking and right-breaking putts, respectively. The amount of break is identified by the degree of slope (noted mentally at an earlier step above). After mastering these left-breaking and right-breaking putts at various distances from the hole, he moves around the clock to the 4:00 o'clock and 5:00 o'clock positions, and then to the 7:00 o'clock and 8:00 o'clock positions. These are the uphill left-breaking and uphill right-breaking putts, respectively. Then he proceeds to the 10: 00 o'clock and 11: 00 o'clock positions, and then to the 1:00 O'clock and 2:00 O'clock positions. These are the downhill left-breaking and downhill right-breaking putts, respectively.

Eventually, the golfer learns to extrapolate the skills learned in a specific hole and, by reading the slope and the extent of the slope of a golf green at the rim of a hole, noting the approach of the ball to the hole relative to the high point on the green (the 12:00 O'clock position), and noting also the distance of the ball to the hole, he can accurately estimate the degree of correction required in order to sink the putt. Finally, the golfer may even become so adept at reading the green that he can accurately estimate the slope and the extent of the slope of the golf green at the rim of the hole without using the training aid 10.

Alternate Embodiments

Figure 3:
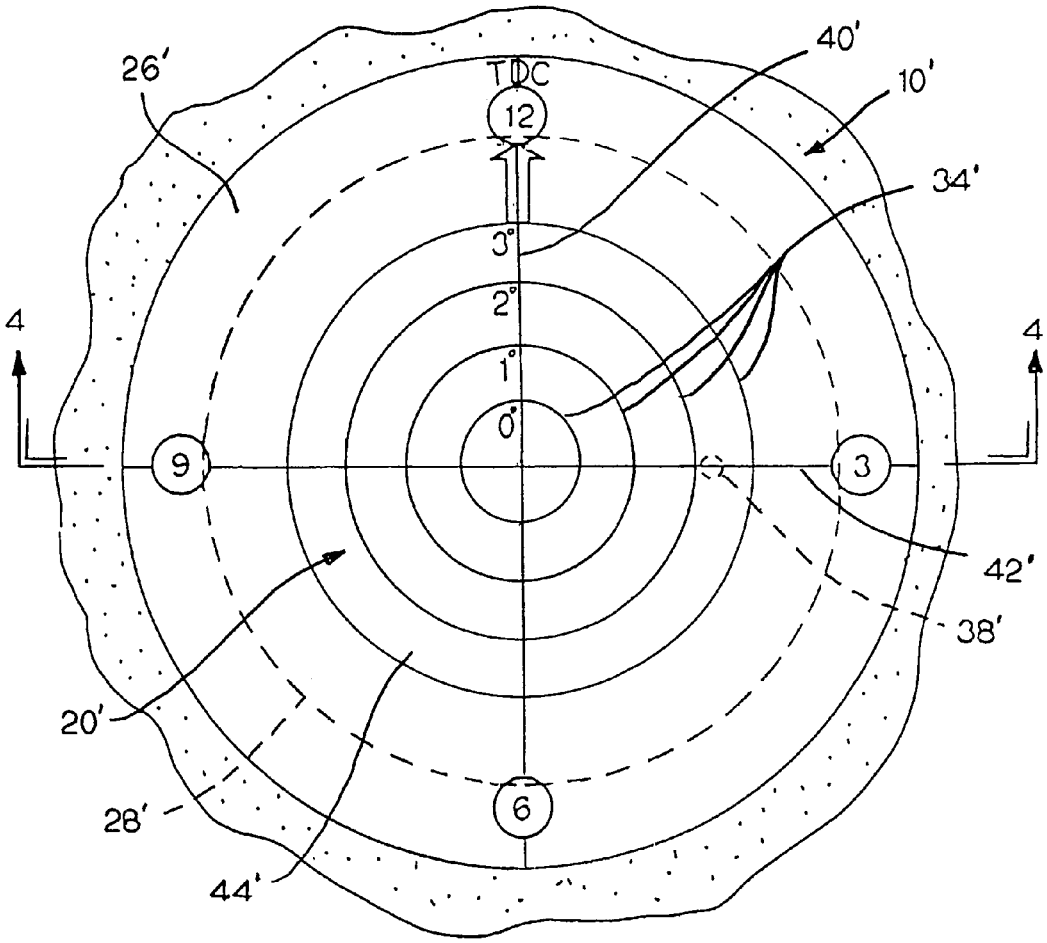
FIG. 3 is a plan view of a second embodiment of a putter's training aid made in accordance with the present invention, as installed in a golf hole.
Figure 4:
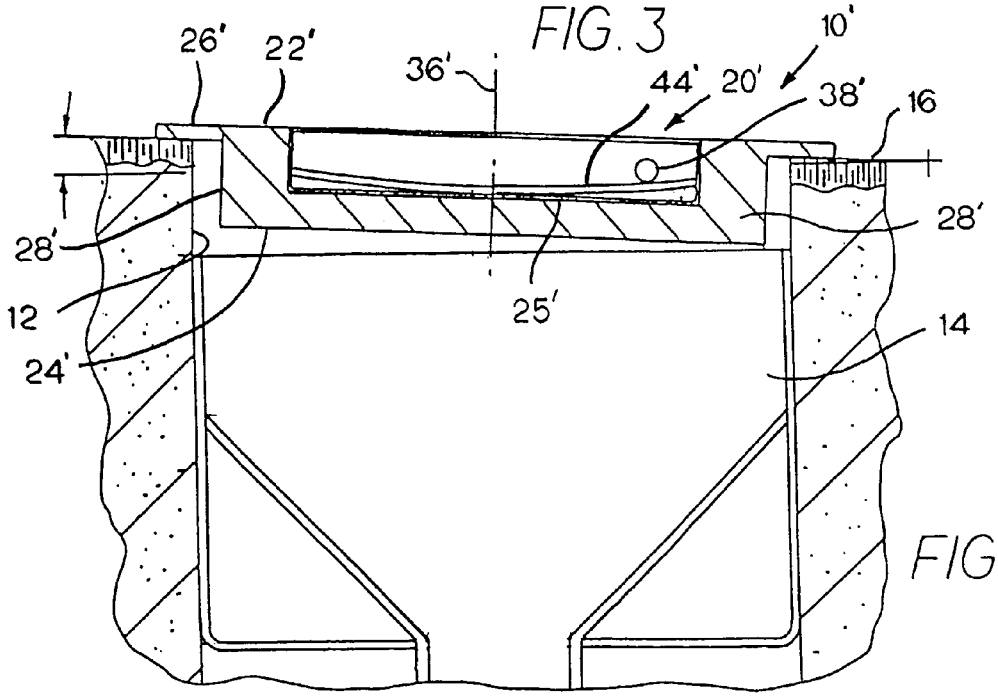
FIG. 4 is a broken-away, section view along line 4—4 of FIG. 3.

FIGS. 3 and 4 depict an alternate embodiment of a putter's training aid 10', made in accordance with the present invention. Parts which are similar to the parts of the previously described putter's training aid 10 are indicated with the same number except that a prime (') is added.

This putter's training aid 10' is very similar to the putter's training aid 10 described above, except that the level indicator 20' utilizes a spherical ball 38' which rolls over a concave surface 44' instead of the bubble 38 floating in a liquid. Naturally, the spherical ball 38' rolls down to indicate the low spot of the slope on the green 16, and the degree or extent of that slope, instead of the bubble 38, which floats up to indicate the high spot of the slope on the green 16, and the degree or extent of that slope, as in the case of the putter's training aid 10.

The only difference this makes is that, when using this embodiment of the putter's training aid 10', the golfer rotates the putter's training aid 10' until the 6 o'clock marking is vertically aligned with the ball 38' in order for the top dead center or 12 o'clock marking 40 to be in the proper position. The rest of the method for use in training a golfer remains the same in both embodiments 10 and 10'.

Figure 5:
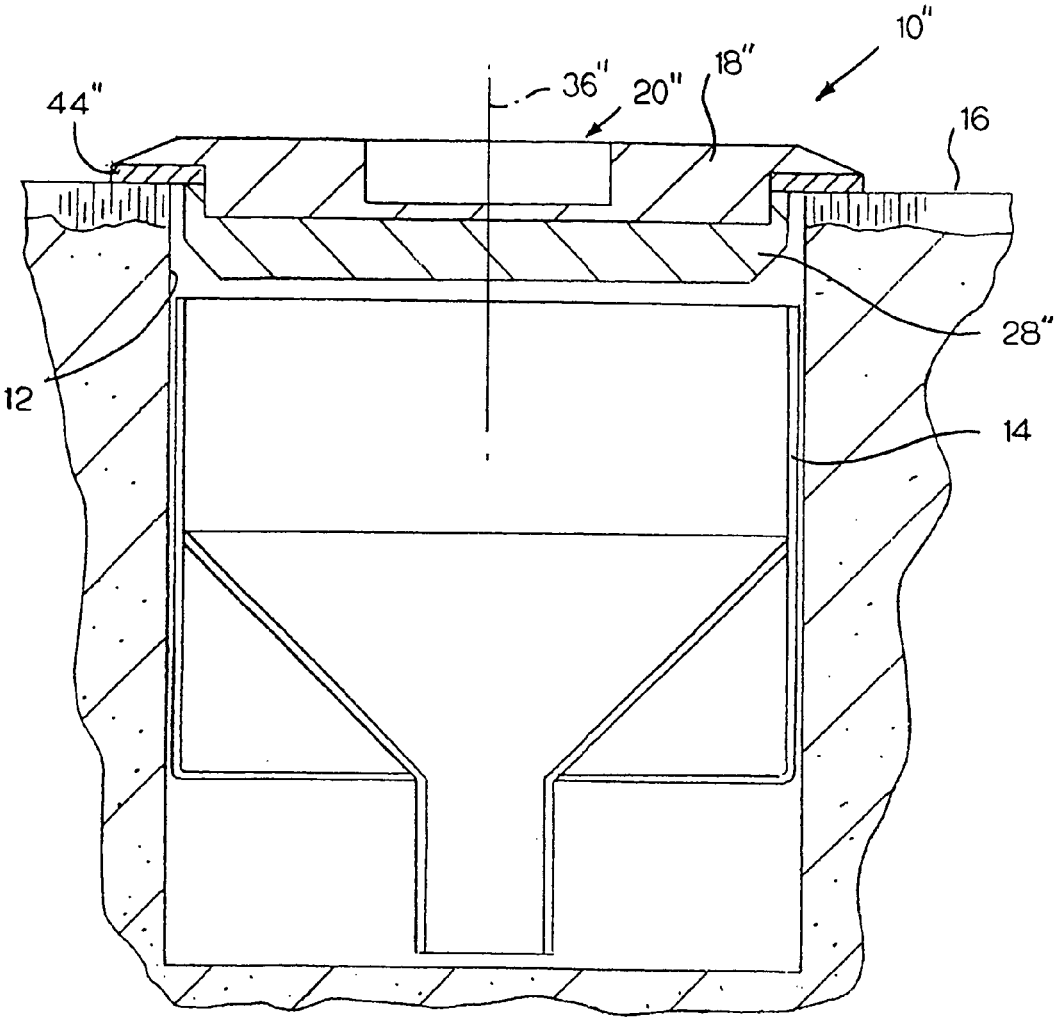
FIG. 5 is a broken-away, section view, similar to that of FIG. 4, but for a third embodiment of a putter's training aid made in accordance with the present invention.

FIG. 5 depicts a third embodiment of a putter's training aid 10", made in accordance with the present invention. Parts which are similar to the parts of the previously described putter's training aid 10 are indicated with the same number except that a double prime (") is added.

This putter's training aid 10" is very similar to the putter's training aid 10 described above, except that a guide ring 44"

type of flange is added between the body 18" and the base 28". In this embodiment 10", the body 18", which houses the slope indicator 20", is a separate piece from the base 28" and is in fact designed and made so that the body 18" snaps into the base 28", capturing the guide ring 44" in between the body and the base. However, the guide ring flange 44" is only loosely captured between the body 18" and the base 28" so that the putter's training aid 10" may rotate about the axis 36" while the guide ring 44" remains stationary on the green 16 surrounding the hole 12. Proper selection of the materials of construction for the ring 44" and/or the body 18" (such as the use of Teflon® or Teflon® impregnated plastics (Teflon® is a Dupont registered trademark)) may result in reduced frictional resistance to rotation of the putter's training aid 10".

Of course, there are other ways to loosely attach the ring 44" to the putter's training aid 10" without having the base 28" and the body 18" be two separate pieces. For instance, the ring 44" may be a two-part (or a multi-part) ring which is assembled onto a retaining groove in the putter's training aid 10".

Figure 6:
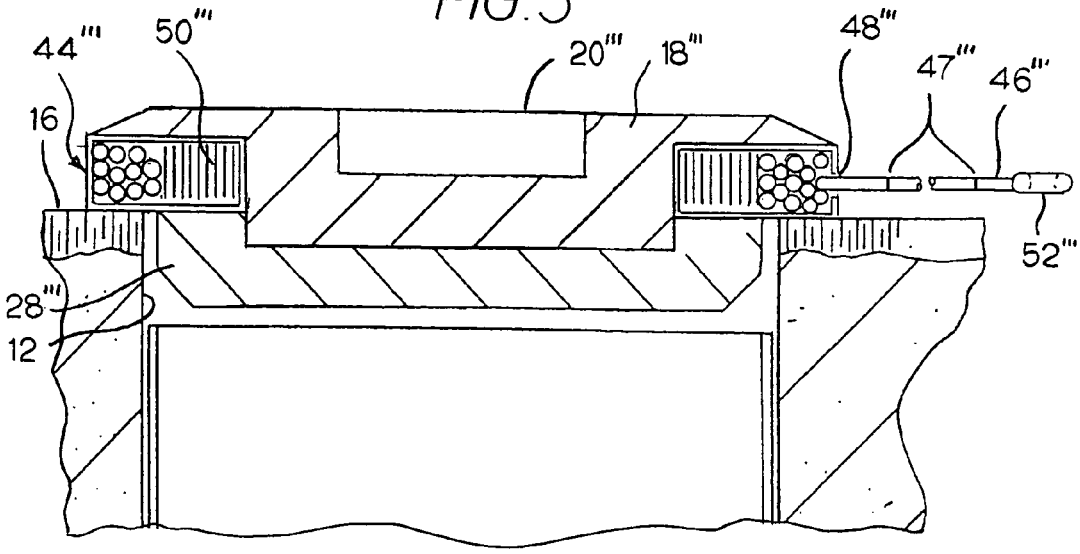
FIG. 6 is an enlarged, broken-away, section view, similar to that of FIG. 5, but for a fourth embodiment of a putter's training aid made in accordance with the present invention.

FIG. 6 depicts a fourth embodiment of a putter's training aid 10''', made in accordance with the present invention. Parts which are similar to the parts of the previously described putter's training aid 10 are indicated with the same number except that a triple prime (''') is added.

This putter's training aid 10''' is very similar to the putter's training aid 10" described above, except that the guide ring flange 44''' also doubles as a reel mechanism to play out and coil back in a cord 46''' (or tape measure). The cord 46''' is marked in increments 47''' (such as one foot increments) and it is pulled out from the ring 44''' through an outlet opening 48''' by pulling on the tab (or handle) 52'''. A coiled spring 50''' is used to retrieve the cord 46''' back into the ring 44''', as is well known in the industry.

The use of this putter's training aid 10''' is very similar to that of the other putter's training aids 10 and 10' described above. Once the bubble in the slope indicator 20''' is showing the direction and extent of the slope on the green, and the putter's training aid 10''' has been rotated so that the "Top Dead Center" or 12:00 O'clock position is aligned with (and closest to) the bubble. The ring 44''' is rotated until the tab 52''' (and thus also the opening 48''') is lined up with the "Top Dead Center" position of the body 18'''. The tab 52''' is then pulled to play out the cord 46'''. The golfer may now use the cord 46''' to measure a distance from the hole 12 along a direction aligned with the "Top Dead Center" position. As may be appreciated, since the ring 44''' can be rotated independently of the putter's training aid 10''', the ring 44''' can be used to measure a distance from the hole 12 radially along any direction desired, not just a position aligned with the "Top Dead Center" position. Therefore, the ring 44''' may be used to set up a putt from any desired distance and from any desired angle of approach to the hole 12, and do so consistently, accurately and conveniently.

Once the distance and angle of approach to the hole 12 have been measured, the putter may put a ball mark or a coin at the measured location(s). Once the cord 46''' is released, it is automatically wound back into the ring 44''' for convenient transport and storage. The complete putter's training aid 10''' may be removed from the hole 12, and the hole 12 will then be prepared for practicing the different putts.

While the embodiments described above show a device for training a golfer to putt a ball into a hole, as well as describing a method for training a golfer to putt a ball into a hole, it will be obvious to those skilled in the art that modifications may be made to the embodiments and methods described above without departing from the scope of the present invention.

What is claimed is:

1. A slope indicator for indicating the slope of a golf green at the rim of a standard hole, comprising:

a golf green defining a standard hole;

a cup in said standard hole;

a body having a top and a bottom and including a radially outwardly-projecting flange which rests on said golf green and a base projecting downwardly from said flange into said standard hole, said base having a diameter that is between 50% and 99% of the diameter of said standard hole, said flange having a diameter that is at least 105% of the diameter of said standard hole, and said base projecting downwardly from said flange a distance between 1% and 100% of the diameter of said standard hole; and means on said body for visually indicating the slope of said flange, said means being viewable from said top of said body.

2. A slope indicator for indicating the slope of a golf green at the rim of a hole as recited in claim 1, wherein said body defines a longitudinal axis extending from said top to said bottom and said means for indicating the slope is rotatable about said longitudinal axis while said base is within said standard hole.

3. A slope indicator for indicating the slope of a golf green at the rim of a hole as recited in claim 2, wherein said means for indicating the slope includes a circular bubble level mounted on said body.

4. A slope indicator for indicating the slope of a golf green at the rim of a hole as recited in claim 3, wherein said circular bubble level includes a plurality of indicia to mark the extent of the slope.

5. A slope indicator for indicating the slope of a golf green at the rim of a hole as recited in claim 3, wherein the top of said body includes radially oriented markings.

6. A slope indicator for indicating the slope of a golf green at the rim of a hole as recited in claim 2, wherein said means for indicating the slope includes a spherical ball on a concave surface mounted on said body.

7. A slope indicator for indicating the slope of a golf green at the rim of a hole as recited in claim 6, wherein said means for indicating the slope includes a plurality of indicia to mark the extent of the slope.

8. A slope indicator for indicating the slope of a golf green at the rim of a hole as recited in claim 6, wherein the top of said body includes radially oriented markings.

9. A slope indicator for indicating the slope of a golf green at the rim of a hole as recited in claim 1, wherein said base has a diameter that is at least 70% of the diameter of the standard hole, said flange has a diameter that is at least 110% of the diameter of the standard hole, and said base projects downwardly from said flange a distance not greater than 50% of the diameter of the standard hole.

10. A slope indicator for indicating the slope of a golf green at the rim of a hole as recited in claim 2, and further comprising a guide ring between said body and said base, wherein said flange rests upon said guide ring and said body may rotate within said ring.

11. A slope indicator for indicating the slope of a golf green at the rim of a standard hole, comprising:

a body having a top and a bottom and including a radially outwardly-projecting flange and a base projecting downwardly from said flange, said base having a diameter that is between 50% and 99% of the diameter of the standard hole, said flange having a diameter that is at least 105% of the diameter of the standard hole, and said base projecting downwardly from said flange a distance between 1% and 100% of the diameter of the standard hole;

means on said body for visually indicating the slope of said flange, said means being viewable from said top of said body; and a guide ring between said body and said base, wherein said flange rests upon said guide ring and said body may rotate within said ring, and wherein said guide ring further comprises a line dispensing and rewinding mechanism.

* * * * *